US007500488B1

(12) United States Patent
Long

(10) Patent No.: US 7,500,488 B1
(45) Date of Patent: Mar. 10, 2009

(54) APPARATUS FOR CLEANING SOIL FROM FOOTWEAR

(76) Inventor: Michie R. Long, 1500 Chuckanut Crest, Bellingham, WA (US) 98229

( * ) Notice: Subject to any disclaimer, the term of this patent is extended or adjusted under 35 U.S.C. 154(b) by 553 days.

(21) Appl. No.: 11/354,478

(22) Filed: Feb. 14, 2006

(51) Int. Cl.
*B08B 3/00* (2006.01)

(52) U.S. Cl. ..... 134/136; 134/133; 134/198; 134/200; 134/201

(58) Field of Classification Search ..... 134/114, 134/133, 136, 154, 155, 198, 200, 201
See application file for complete search history.

(56) References Cited

U.S. PATENT DOCUMENTS

| | | | | |
|---|---|---|---|---|
| 3,641,609 | A | 2/1972 | Hansen | |
| 3,802,021 | A | 4/1974 | Schulz | |
| 3,925,830 | A | 12/1975 | Delaney | |
| 4,358,867 | A | 11/1982 | Berta | |
| 4,587,148 | A * | 5/1986 | Campbell et al. | 428/88 |
| 4,784,327 | A | 11/1988 | Lund | |
| 4,918,779 | A | 4/1990 | Burns | |
| 4,984,746 | A | 1/1991 | Joyal | |
| 5,173,972 | A | 12/1992 | Goodman | |
| 5,522,552 | A | 6/1996 | Liu et al. | |
| 5,588,175 | A * | 12/1996 | Zahner | 15/310 |
| 5,673,856 | A | 10/1997 | Krohn | |
| 5,839,144 | A | 11/1998 | Willner | |
| 5,950,269 | A | 9/1999 | Openshaw et al. | |
| 5,964,959 | A | 10/1999 | Bleth | |
| 5,991,967 | A | 11/1999 | Williams | |
| 6,067,688 | A * | 5/2000 | West | 15/311 |
| 6,074,490 | A | 6/2000 | Brown | |
| 6,079,640 | A | 6/2000 | Merritts | |
| 6,223,379 | B1 | 5/2001 | Martin | |
| 6,382,136 | B1 | 5/2002 | Bragulla et al. | |
| 6,389,631 | B1 | 5/2002 | Keith | |
| 6,406,549 | B1 * | 6/2002 | Berg et al. | 134/1 |
| 6,584,636 | B2 | 7/2003 | Schlem | |
| 6,651,288 | B1 | 11/2003 | Hackett | |
| 6,662,398 | B1 | 12/2003 | Thomson | |
| 6,668,842 | B1 | 12/2003 | Wilke et al. | |
| 6,736,339 | B1 | 5/2004 | Mayers | |
| 6,739,286 | B2 | 5/2004 | Vander Veen | |

(Continued)

FOREIGN PATENT DOCUMENTS

| | | |
|---|---|---|
| EP | 791323 A3 | 6/1999 |

*Primary Examiner*—Michael Barr
*Assistant Examiner*—Rita R Patel
(74) *Attorney, Agent, or Firm*—Todd N. Hathaway

(57) ABSTRACT

An apparatus for removing soil from a shoe, boot or other article of footwear. The apparatus employs a jet of water or other fluid to dislodge and break up the soil. The spray nozzle is housed within a tubular plunger having a discharge opening in its upper end. The plunger is operatively connected to the nozzle, so that stepping on the plunger actuates a flow of water therethrough. The nozzle includes a return spring that biases the valve back to the closed position when the plunger is released. The stream of water is directed through the opening against the surface of the shoe or other article of footwear. The upper end of the plunger is surrounded by a layer of flow-disbursing material that prevents the escape of spray from beneath the article of footwear. The layer of flow-disbursing material may be formed by a layer of coarse, open-cell foam material or by a multiplicity of small, resiliently flexible fingers.

22 Claims, 8 Drawing Sheets

U.S. PATENT DOCUMENTS

| | | | | |
|---|---|---|---|---|
| 6,745,721 | B1 | 6/2004 | Hammer | |
| 2002/0092110 | A1 * | 7/2002 | Blum et al. | 15/215 |
| 2004/0168274 | A1 | 9/2004 | Greely | |
| 2004/0168711 | A1 | 9/2004 | Dickson et al. | |
| 2004/0230144 | A1 | 11/2004 | Weinberger | |

* cited by examiner

APPARATUS FOR CLEANING SOIL FROM FOOTWEAR

BACKGROUND a. Field of the Invention

The present invention relates generally to an apparatus for cleaning dirt and other soil from footwear, and, more particularly, to a foot pressure actuated apparatus for removing soil from footwear using a spray of water.

b. Background Art

The problem of soil being tracked into a dwelling on the bottom of a shoe, boot or other article of footwear has, of course, existed since time immemorial. Perhaps the most odious example is animal excrement, such as dog feces, but mere dirt and earth often cake and collect on the bottom of footwear, such as the boots of a person working in a garden or the shoes of a person walking on a muddy path.

The simplest attempt to deal with this problem, apart from merely trying to kick the soil off against a rock or post, has been the ordinary doormat. However, while the cleaning action of doormats may be acceptable for light accumulations of dirt and debris, it is wholly inadequate for heavy, caked mud or other soil. Moreover, it is unacceptable to have large "globs" of soil, particularly excrement, accumulate on the doormat, where it may be tracked through the entryway and into the dwelling by subsequent users; cleaning doormats, in turn, is a notoriously difficult and unpleasant task.

A related approach has been to provide a grate, usually constructed of metal, that is positioned over a shallow well into which the soil falls. The cost and nature of these assemblies is such that they are generally suited to installation only at public, commercial or institutional facilities, and moreover, their ability to remove soil is no better (and in some cases worse) than that of typical doormats. In a few versions, the grates have been positioned over sewers or otherwise provided with a flow of water to carry soil away from the well, however these features render the apparatus even more complex and less suitable for residential use.

A variety of shoe scrubbing devices and brushes have also been proposed or developed over the years. The earliest and simplest of these devices generally employed a frame or other structure on which the brushes or bristled members are arranged at various angles, for pressing against the bottom and side or sides of a shoe as it is drawn against or through the device. While perhaps more effective at removing soil than an ordinary doormat, such devices are messy to use and tend to smear the soil over the surfaces of the shoe. Moreover, they are tedious and tiring to use, since the user must move the foot back and forth repetitively in order to create the scrubbing action. In more recent years there has been an attempt to overcome this latter problem by using motorized brushes of one form or another, but this has grossly increased cost and complexity and has introduced new liability problems. In some instances, an accompanying flow of water has been provided to wash away the soil dislodged by the rotating/reciprocating brushes, but at the cost of further compounding the complexity of such devices.

Accordingly, there exists a need for an apparatus for removing soil from an article of footwear in a rapid and effective manner. Furthermore, there exists a need for such an apparatus that does not cause the removed soil to accumulate at an entryway or other pathway subject to foot traffic. Still further, there exists a need for such an apparatus that is suitable for use in a residential environment, and that is adaptable to being positioned in a variety of locations. Still further, there exists a need for such an apparatus that is convenient and comfortable for the user to operate. Still further, there exists a need for such an apparatus that is inexpensive to manufacture, and that is reliable and durable in operation.

SUMMARY OF THE INVENTION

The present invention has solved the problems cited above, and is an apparatus for removing soil from a shoe, boot or other article of footwear. Broadly, the apparatus comprises: (a) an actuating member mounted for reciprocating movement and having a portion for being engaged by an article of footwear; (b) a nozzle member and having a discharge end directed towards the article of footwear when in engagement with the actuating member; and (c) means for actuating a flow of fluid through the nozzle member in response to the actuating member being displaced by the article of footwear in engagement therewith, so that the nozzle produces a stream of fluid that is directed against the article of footwear. The means for actuating a flow of fluid may comprise means for actuating a flow of water through the nozzle member.

The actuating member may comprise a plunger member having an opening in an end thereof. The nozzle members may comprise a nozzle member positioned within the plunger member so that the discharge end of the nozzle member is directed towards the opening in the end of the plunger member.

The apparatus may further comprise a flow-dispersing layer located proximate the upper end of the plunger member for receiving at least a portion of the stream of water that is deflected from the article of footwear, so as to prevent unwanted escape of spray from around the article of footwear while soil is being dislodged and removed therefrom.

The flow-dispersing layer may comprise a layer of porous material that surrounds the upper end of the plunger member. The layer of porous material may comprise a resiliently compressible material that compresses under the article of footwear as the plunger member is depressed thereby. The resiliently compressible material may comprise a resiliently compressible open-cell foam material. Alternatively, the flow-dispersing layer may comprise a multiplicity of resiliently flexible fingers arranged about the upper end of the plunger member; the resiliently flexible fingers may be formed of a flexible rubber material.

The apparatus may further comprise a housing having an upper surface, with the upper end of the plunger member protruding upwardly therefrom. The flow-dispersing layer may comprise a layer of flow-dispersing material that is mounted to the upper surface of the housing about the upper end of the plunger member. The upper end of the plunger member may lie substantially flush with the upper surface of the flow-dispersing layer, so that the article of footwear makes contact with the layer of flow-dispersing material before the plunger member is depressed to a position at which the nozzle assembly is actuated.

The discharge opening may be formed centrally in the upper end of the plunger member, or may be formed on, or angled towards, a side thereof.

The nozzle assembly may comprise a self-closing hose nozzle assembly, having a valve that is opened by drawing a rod member rearwardly and a spring that biases the valve to its closed position. The means for actuating the nozzle assembly may comprise a lower portion of the plunger member that is mounted to the rod member of the nozzle assembly, so that the rod member is drawn downwardly to open the valve in response to the plunger member being depressed beneath the article of footwear.

The plunger member may comprise a tubular housing having the nozzle assembly positioned therein. The tubular housing may comprise a lateral opening through which a handle portion of the nozzle assembly protrudes for attachment to a garden hose.

The upper surface of the plunger assembly may be formed of relatively smooth, low friction material so as to minimize resistance to sliding movement of the article of footwear thereon. The upper surface of the plunger member may be formed in a contrasting color to the upper surface of the flow-dispersing layer, so as to provide a visual guide to a user when sliding the article of footwear on the upper end of the plunger member.

The housing may have enclosed sides and at least one bottom opening, so that soil that is dislodged from the article of footwear and carried back down the tubular sleeve will be discharged to the ground under the housing.

These and other features and advantages of the present invention will be more fully appreciated from a reading of the following detailed description with reference to the accompanying drawings.

DETAILED DESCRIPTION

Figure 1:
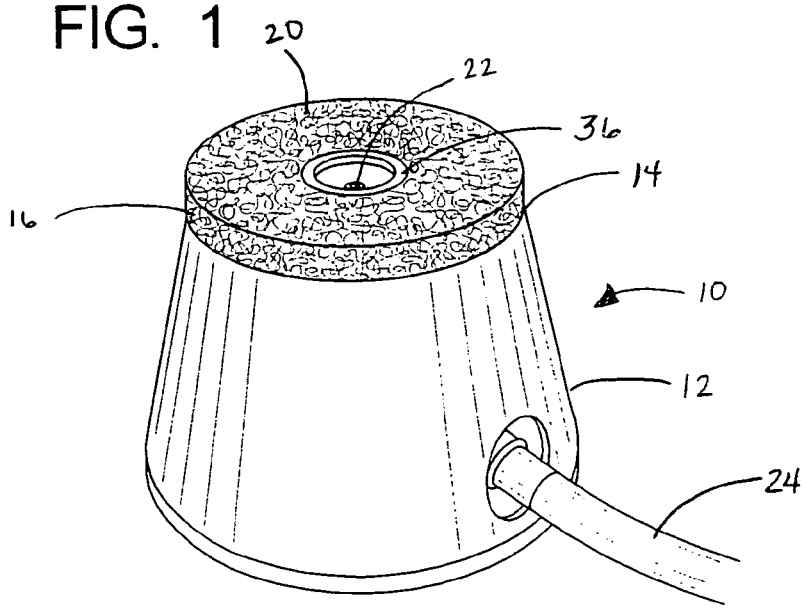
FIG. 1 is a perspective view of a soil removal apparatus in accordance with the present invention, showing this attached to a conventional garden hose via which water is supplied to the apparatus.

FIG. 1 shows a soil removal apparatus 10 in accordance with the present invention. As can be seen, the apparatus includes a housing 12 that is surmounted by an upper surface 14, the latter being sized sufficiently broad to receive the lower surface of a shoe, boot or other article of footwear. In the embodiment that is illustrated, the housing 12 has a generally frusticonical shape, which presents a tidy, compact appearance consistent with use in a residential or garden environment, and which has a circumferential surface to which various forms of decoration can be readily applied. It will be understood, however, that the housing may have other shapes (e.g., square, rectangular, oval and so on), and that in some embodiments the housing may be in the form of an open frame or supports rather than an enclosure. Similarly, the flat, horizontal upper surface 14 that is shown in FIG. 1 is notably versatile and convenient to use, but it will be understood that some embodiments may have sloped, angled or contoured upper surfaces instead. The housing may also include brackets or other features for mounting it to a stationary surface or support for added stability.

As can be seen with further reference to FIG. 1, a layer a flow-dissipating material 16 is mounted on the upper surface of the housing 12. As will be described in greater detail below, the flow dissipating material serves to slow and spread the flow of water or other fluid after it has impacted the bottom of the shoe or other article of footwear, so as to prevent spray from escaping to the sides during operation of the apparatus. The layer 16 of flow-dissipating material, in the embodiment that is illustrated in FIGS. 1-5, is preferably a coarse resiliently compressible, open cell foam material, formed of PVC, polyethylene, or polyurethane, for example. The material preferably has a high degree of permeability, in order to allow relatively free flow of water therethrough and thereby avoid collection/accumulation of soil; an eminently suitable material is SIF-PVC (polyvinyl coated) filter foam, available from Variegated Film, Inc. (Dayton, Ohio). It will be understood, however, that other resiliently compressible materials and structures that allow water to pass therethrough while dissipating its flow and slowing its velocity, may be used as well; moreover, in some embodiments the flow-dissipating material may not be included or may be present only in certain areas. The flow-dissipating material may also be in the form of a replaceable pad, and may in some embodiments have a non-uniform thickness. The layer of foam flow-dissipating material that is shown is suitably about ¾-1 inch thick depending on the compressibility of the material and the length of travel required to open the valve of the nozzle assembly.

A spring-biased plunger member 20 is located generally centrally in the upper surface 14, so as to be surrounded by the flow-dispersing layer 16, with its upper end protruding above the flow dissipating layer as shown in FIG. 1. The upper end of the plunger member includes an opening 22; through which a spray of water is directed, the water being supplied to the apparatus under pressure via a conventional garden hose 24.

Figure 2:
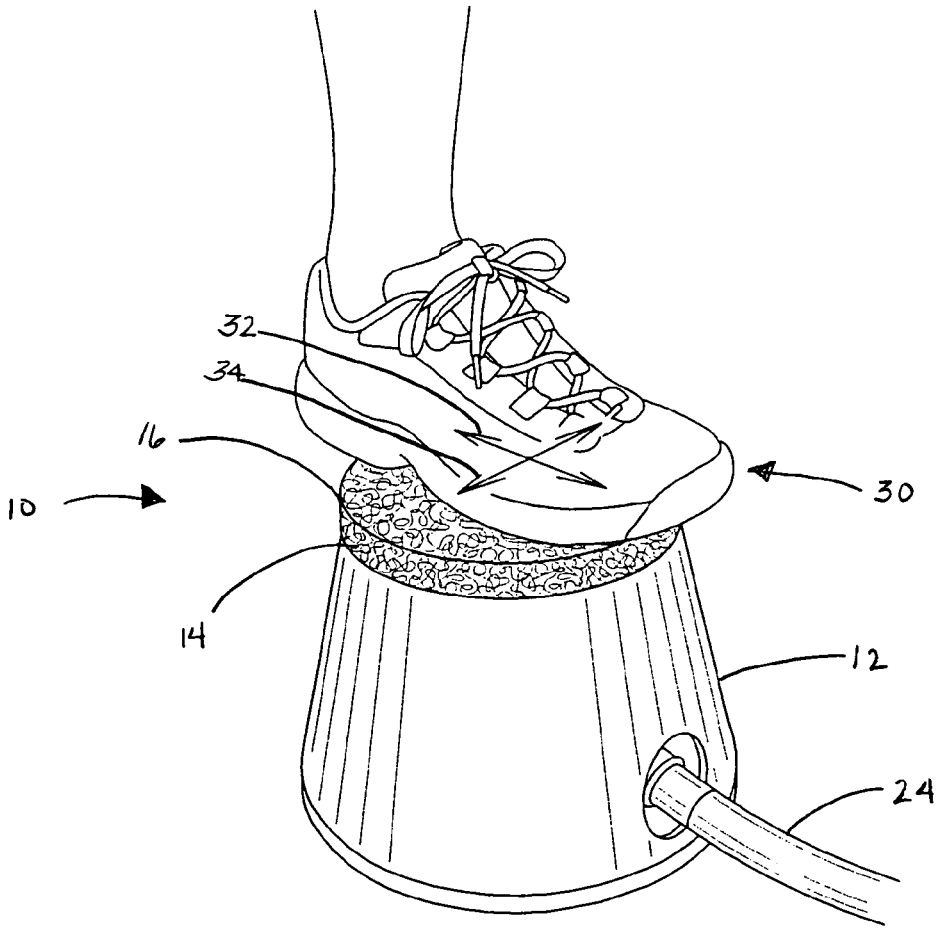
FIG. 2 is a second perspective view of the soil removal apparatus of FIG. 1, showing the manner in which it is actuated by applying foot pressure to the upper surface thereof.

As can be seen in FIG. 2, and as will be described in greater detail below, the apparatus is actuated by stepping downwardly on the upper end of the assembly. The shoe 30 or other article of footwear thus depresses the plunger member 20, actuating the flow so that a jet of water is directed upwardly through the center opening 22. Simultaneously, the lower surface of the shoe (i.e., the bottom of the sole) comes into contact with and partially compresses the layer of flow dissipating material 16 that surrounds the plunger and opening.

As a result, the jet of pressurized water impacts against the bottom of the shoe 30 so as to remove soil therefrom. The majority of the flow then returns back down the hollow interior of the plunger, with the remainder being deflected outwardly across the bottom of the shoe and into the layer of flow dissipating material 16. The high-pressure water is thus able to dislodge and remove even impacted soil very effectively, with virtually no spray escaping to the sides of the assembly. The user need only move the foot about slightly, as indicated by arrows 32, 24 in FIG. 2, to remove soil from the entire underside of the shoe with minimal exertion. As this is being done, the annular upper surface 36 of the plunger member provides a visual guide for the user, when it appears exposed at the edges of the shoe, so that the user can avoid uncovering the central opening 22 in a manner that would allow the jet of water to escape; for this reason, the upper surface of the plunger member may be formed in a color that contrasts with that of the surrounding layer of flow-dissipating material.

When the soil has been removed from the shoe, the foot is simply lifted away from the upper end of the assembly, and the plunger member returns to its elevated position, terminating the flow of water. If desired, the other shoe can then be placed on the apparatus and cleaned in the same manner.

Figure 3:
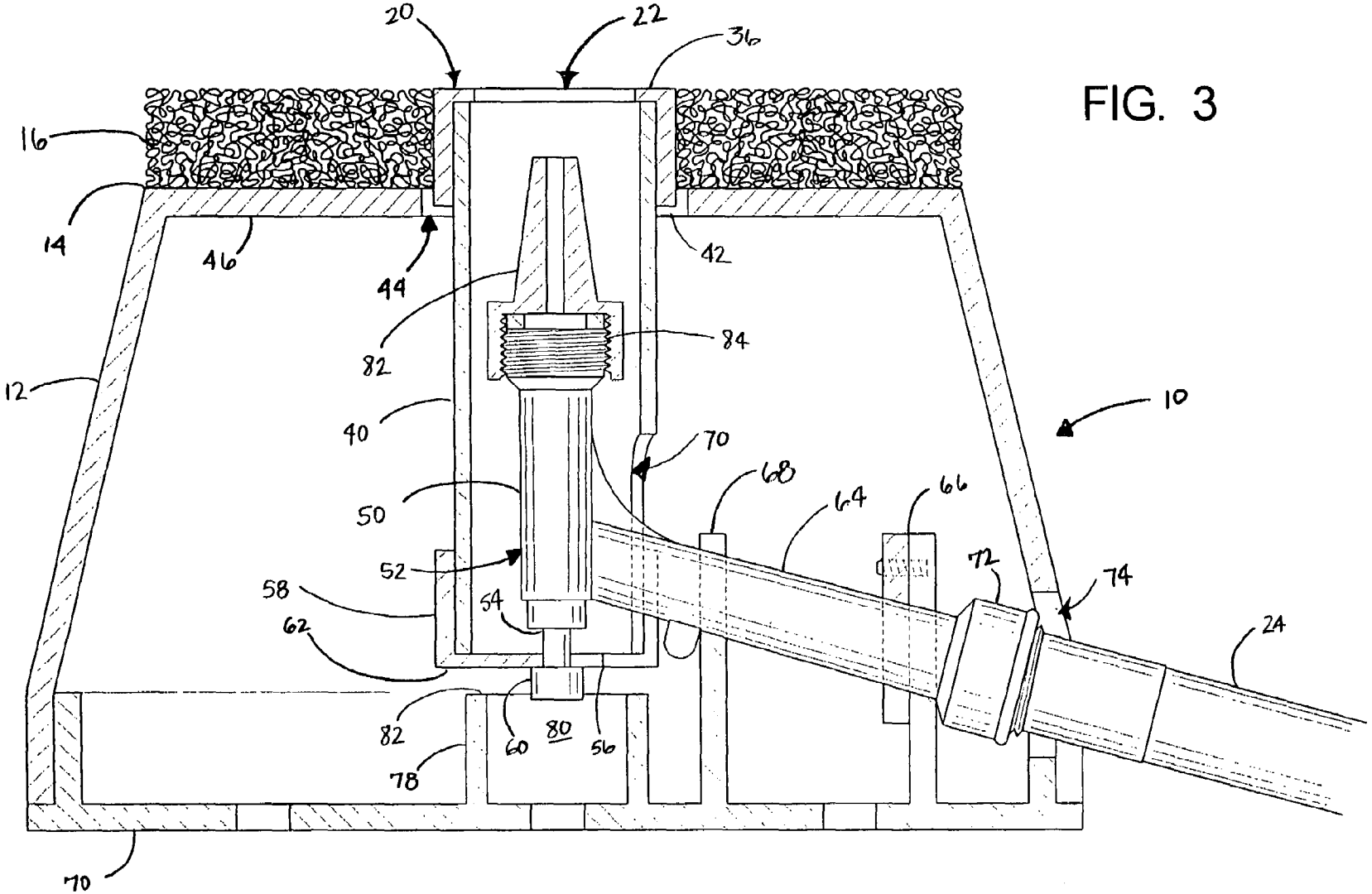
FIG. 3 is a cross-sectional view of the soil removal apparatus of FIGS. 1-2, showing the internal structure and components of the apparatus and their relationship when the plunger portion thereof is in its raised position as seen in FIG. 1.

As can be seen in FIG. 3, the plunger member of the illustrated embodiment includes a tubular sleeve 40 that extends along an axis generally perpendicular to the upper surface 14 of the housing 12. A cap 42 is mounted over the upper end of the sleeve, with a hole therein forming the central spray opening 22. The external diameter of the cap is just slightly smaller than the diameter of an opening 44 in the upper wall 46 of the housing, through which the sleeve extends, so that the cap and sleeve are free to reciprocate therethrough while being maintained in proper alignment with respect to the housing and the flow-dispersing layer 16.

The sleeve 40 encloses the barrel portion 50 of a nozzle assembly 52, with the barrel being held in coaxial alignment with the sleeve (i.e., so that the barrel is aligned vertically, in the embodiment that is illustrated). The nozzle assembly is suitably a conventional self-closing pistol-grip spray nozzle, of the type commonly used with garden hoses, with the actuating lever having been removed or deleted; typical nozzles of this type are available, for example, from L. R. Nelson Corporation, of Peoria, Ill. (e.g., Model No. 2214) and Gilmour Group of Somerset, Pa. (e.g., Model No. 474). Since such nozzles are standard items, the cost of manufacturing a dedicated component is avoided; it will be understood, however, that some embodiments may employ a dedicated component nozzle and/or valve assembly that functions in a similar manner, rather than using an off-the-shelf nozzle assembly as shown.

Self-closing, hose nozzles of the type described above conventionally employ a valve that is opened by drawing a shaft at the back of the nozzle in a rearward direction, the shaft being biased forwardly by a spring so as to return the valve to its closed position when released. As can be seen is shown in FIG. 3, the shaft 54 of the nozzle assembly 52 extends downwardly, through an opening 46 in a second cap 58 that is mounted to the bottom of the sleeve 40. A nut 60 is mounted to the distal end of the shaft so as to butt against the lower surface 62 of the bottom cap; the nut 60, which is normally acted on by the lever of a conventional pistol-grip nozzle, may be threaded onto the end of the shaft, or it may be mounted to or formed on the shaft in any other suitable manner.

The tubular grip portion 64 of the nozzle assembly is held fixedly by a clamp 66 and support 68 that extend upwardly from the base 70 of the housing, so that the nozzle assembly is maintained in a stationary position with its barrel aligned with the sleeve 40 of the plunger member in the manner described above. The grip 64 extends through a vertically elongate opening 70 that is formed in the sleeve near its lower end, thus allowing the plunger member to reciprocate vertically while the nozzle assembly remains stationary. The distal end of the grip portion extends in a generally lateral direction, with the female hose fitting 72 at its base being positioned at an opening 74 in the wall of the housing, via which the hose 24 can be connected to the nozzle assembly.

When the assembly is at rest, the plunger member 20 is biased upwardly to the position that is shown in FIG. 3, as a result of the nut 60 on the spring-loaded shaft pulling upwardly on the bottom surface 62 of the lower end cap. The valve of the nozzle assembly is thus closed, and the annular upper surface 36 of the plunger member lies substantially flush with the upper surface of the compressible, flow-dispersing layer 16.

Figure 4:
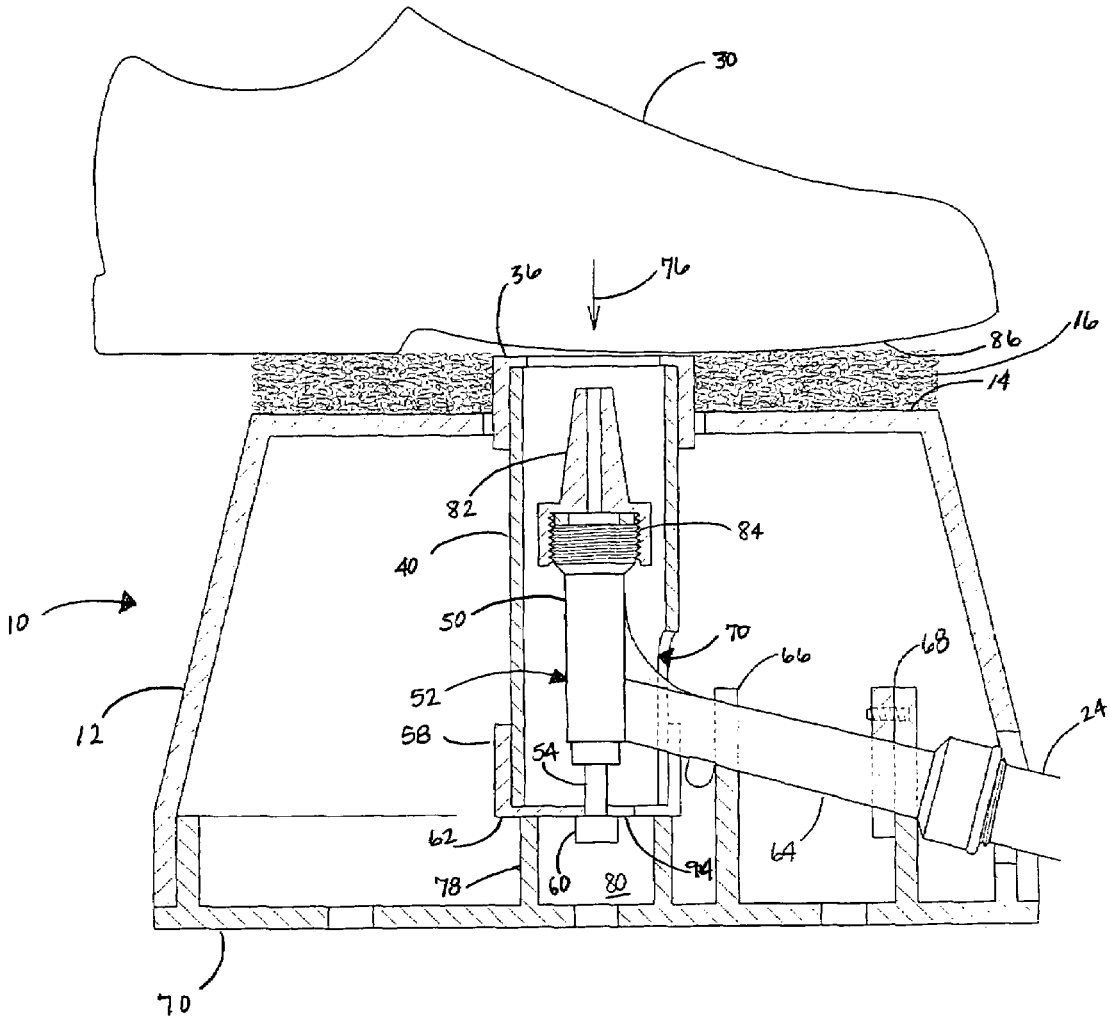
FIG. 4 is a second cross-sectional view of the soil removal apparatus of FIGS. 1-2, showing the relationship of the components thereof when the actuating plunger is depressed by stepping thereon, as seen in FIG. 2.

Then, when a user steps on the top of the assembly, the downward pressure of the foot against the upper surface 36 of the plunger member overcomes the force of the valve spring (in nozzle 52), so that the plunger member is depressed in the direction indicated by arrow 76 in FIG. 4. The bottom surface 62 of the plunger consequently presses downwardly against nut 60, drawing the shaft 54 downwardly and opening the valve in the nozzle assembly. An annular wall 78 defines an opening 80 in the base that accommodates nut 60 as the latter descends therein, with the upper edge 82 of the wall meeting against the lower cap of the plunger to form a stop that prevents potential damage to the valve mechanism.

When the valve of the nozzle assembly is thus opened, water flows through the nozzle assembly and is discharged in a substantially solid stream through a jet-type sweeper nozzle 82 that is mounted on the threaded end 84 of the barrel portion 50. Suitable sweeper nozzles are available from R. L. Nelson Company (e.g., Part No. N26C), and equivalents are available from many other suppliers; it will be understood that nozzles giving other suitable spray patterns may be used, and that the nozzles may be a separate part as shown or may be formed integral with the nozzle assembly.

The stream from the nozzle is directed axially, through the upper opening 22 of the plunger member and against the bottom surface 86 of the shoe 30 or other article of footwear, providing a powerful, concentrated flow that quickly dislodges and breaks up any soil thereon. In general, it is important that the spacing between the nozzle and the bottom surface of the shoe be sufficiently close that the stream impacts the bottom of the shoe almost immediately before beginning to spread and dissipate its energy, but not so close that the stream builds up a back pressure against itself; for use with typical residential water pressures and the type of nozzle described above, a spacing of about ½ inch between the nozzle tip and bottom surface 86 of the shoe has been found optimal.

Figure 5:
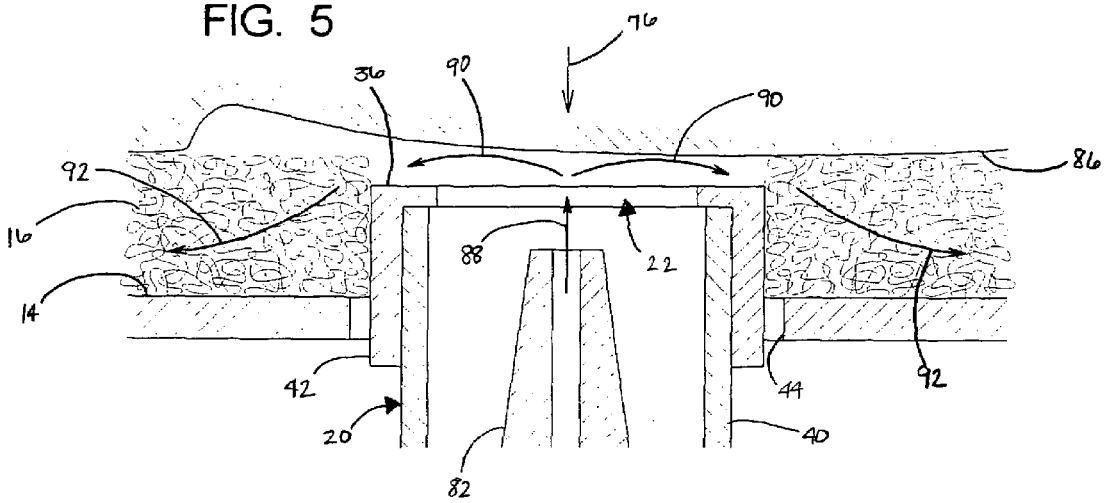
FIG. 5 is a third cross-sectional view of the soil removal apparatus of FIGS. 1-2, enlarged to show the soil removal action that is generated by water flowing upwardly from the plunger mechanism against the lower surface of the shoe or other article of footwear.

As noted above, the upper surface 36 of the plunger member lies flush with the top of the flow-dispersing layer 16 when the plunger member is in its raised position. Consequently, the plunger member does not begin to depress until the bottom surface 86 of the shoe has come into contact with the surrounding flow-dispersing layer, which then compresses resiliently as the plunger member is depressed. Consequently, as shown in FIG. 5, the spray opening 22 is completely surrounded by the partially compressed flow-dispersing material, pressing upwardly against the bottom of the shoe, by the time that the water flow is actuated, thus obviating any possibility of the water escaping and spraying out to the side in a manner that would wet the surroundings (e.g., the user's other leg). However, because the downward load is borne primarily by the relatively slick upper surface 36 of the plunger member (which is suitably formed of rigid, low-friction plastic) and the flow-dissipating material is only partially compressed, the shoe is easily slid about with minimal effort.

Thus, as can be seen in FIG. 5, the flow from the nozzle assembly is directed upwardly against the bottom surface of the shoe as indicated by arrow 88, to directly impinge the soil thereon. After breaking up the soil, the bulk of water returns at a reduced velocity back down tubular sleeve 40 and is discharged (along with the suspended soil) through an opening or openings 70 to the ground underlying the housing. A portion of the pressurized spray/flow is also deflected outwardly between the opposing surfaces of the shoe and plunger member, in the direction indicated by arrows 90. Since the gap in this area (i.e., between the bottom 86 of the sole and the top 36 of the plunger) is comparatively small, the flow maintains a high rate so as to break up and carry away the soil, as well as providing a degree of lubrication that further reduces frictional resistance between the two surfaces. The outward flow then enters the layer of flow-dissipating material and slows, flowing outwardly and downwardly in the direction indicated by arrows 92, eventually spreading outwardly over the upper surface of the housing. Since the soil has, by this point, been reduced to fine particulates and/or solubilized, it is carried along by the flow in a highly dilute form and does not accumulate in an objectionable mass. The flow can then simply discharge over the sides of the housing, or through drain openings formed in its upper surface 14; in some embodiments, the layer of flow-dissipating material may be mounted or recessed in a well in the top of the housing to contain the outward flow so that it escapes primarily through the downward drain holes. Any soil remaining in the flow-dispersing layer following use can easily be removed by simply spraying the assembly using a garden hose.

As described above, the fluid used to dislodge and carry away the soil will generally be neat water, e.g., supplied from a garden hose. It will be understood, however, that other fluids may be utilized, such as a detergent solution or a recirculating disinfectant, for example.

Figure 6:
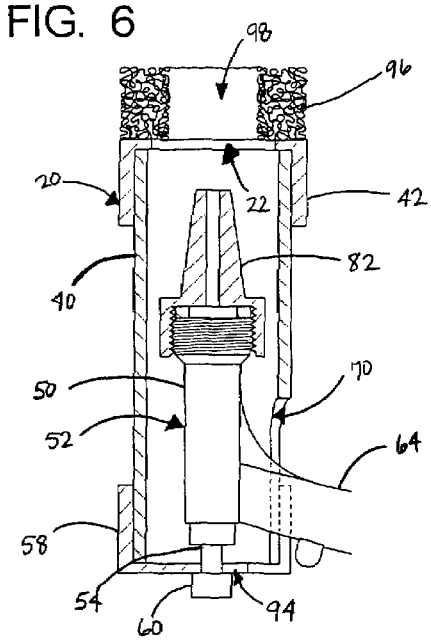
FIG. 6 is a cross-sectional view of the plunger mechanism of a soil removal apparatus in accordance with a second embodiment of the present invention, having a layer of coarse flow-dissipating material mounted on top of the plunger mechanism as well as on the surrounding surface of the housing.

As noted above, in the embodiment that is shown in FIGS. 1-5, the upper surface of the plunger member (which is suitably formed of PVC or other rigid plastic) is exposed at the surface of the assembly, which allows the shoe or other article of footwear to be slid about with minimal effort. However, as is shown in FIG. 6, some embodiments may feature an additional, annular layer 96 of foam or the flow-dispersing material that is mounted to the upper end of the plunger member, having a central opening 98 that is aligned with the opening 22 in the plunger member; the annular layer of foam material provides an additional seal against the bottom of the shoe to prevent the lateral escape of spray.

FIGS. 7-12 show additional configurations of the plunger member, which may be used in place of the configuration that is shown in FIGS. 1-5 or interchangeably therewith, i.e., by removing a first plunger member from the assembly and replacing it with another having a different configuration.

Figure 7:
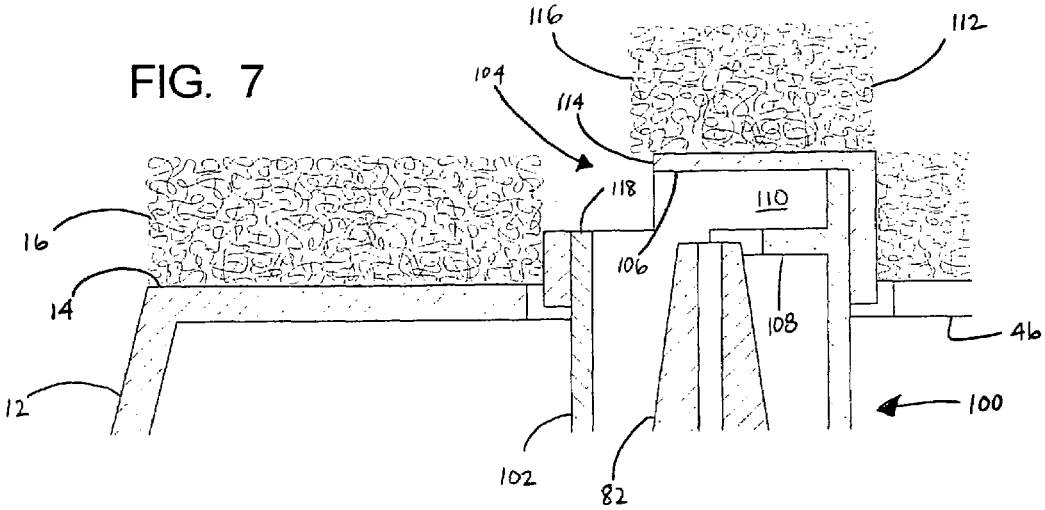
FIG. 7 is a partial, cross-sectional view of the upper surface and plunger mechanism of a soil removal apparatus in accordance with a third embodiment of the present invention, in which the top of the plunger mechanism is configured to discharge water generally in a lateral direction against the side of a shoe or other article of footwear.
Figure 8:
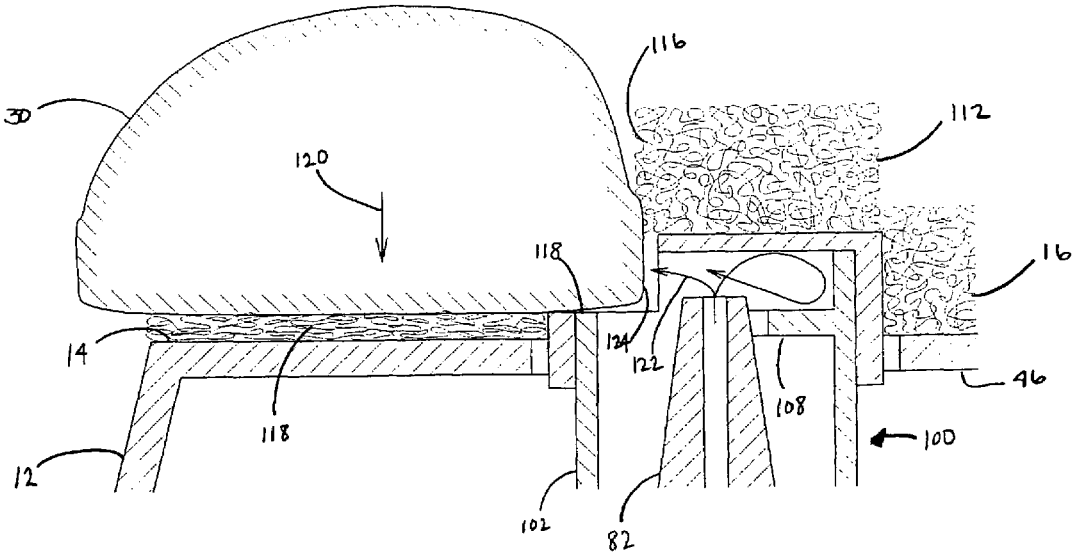
FIG. 8 is a second, cross-sectional of the upper surface and plunger mechanism of the soil removal apparatus of FIG. 7, showing the manner in which stepping downwardly against an edge of the plunger mechanism actuates the flow of water so that it is directed against the side of the sole of the shoe.
Figure 9:
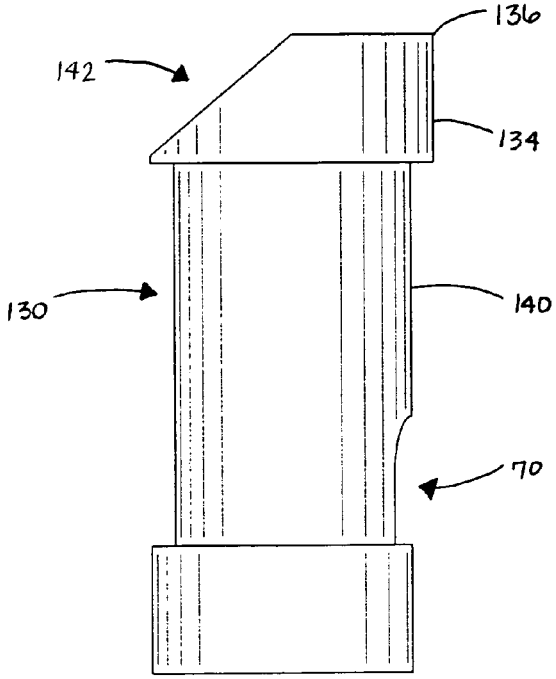
FIGS. 9-10 are, respectively, elevational and plan views of the actuating plunger of a soil removal apparatus in accordance with a fourth embodiment of the present invention, in which the flow of water is directed in both upward and lateral directions against the shoe or other article of footwear.

The plunger member 100 that is shown in FIGS. 7-8 includes a tubular sleeve 102 that houses a nozzle assembly, similar to the embodiment described above. However, rather than having a central, vertically-directed opening, the upper end of the sleeve and cap 104 have a "stepped" configuration with an opening 104 on one side. The top wall 106 of the cap extends directly over the tip of the nozzle 82, so that it will be impinged by the stream of water discharged therefrom. A divider wall 108 projects inwardly from the side of the sleeve 102 at a spaced distance below the upper wall 106 of the cap, approximately level with the tip of the nozzle 82, so as to define a partially enclosed chamber 110 on the opposite side from opening 104. A layer 112 of the flow-dissipating foam material, in turn, is mounted over the top wall 106 of the cap member, and projects over the lip 114 thereof at opening 104, to form an overhang in the area indicated at 116.

To actuate the assembly, the user places the edge of his shoe in the opening 104 and steps downwardly against the cutaway upper edge 118 of the sleeve, in the direction indicated by arrow 120 in FIG. 8, thus depressing the plunger member and opening the valve of the nozzle assembly in the manner described above. The flow discharged from the nozzle tip impinges on the overlying wall 106, with a portion of the flow being directed immediately in a lateral direction through opening 104; the remainder of the flow circulates into chamber 110 and is then redirected laterally, as indicated by arrows 122 in FIG. 8. As the water exits the opening 104, it impacts soil along the bottom edge 124 of the shoe, removing it therefrom in a manner similar to that described above. The area 116 of the foam material that overhangs the upper lip of the opening presses against the side of the shoe to prevent a spray of water from escaping upwardly as this is done. The layer of foam beneath the shoe, in turn, in the area indicated at 118, is simultaneously compressed to prevent spray from escaping laterally. Soil along the edges of the shoe can therefore be removed by simply stepping down on the edge of the plunger member in the manner described above, and then drawing the edge of the shoe slowly along and through the opening 104.

Figure 10:
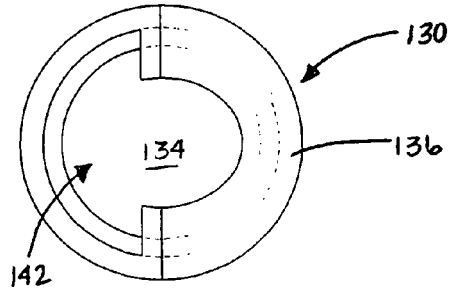
Figure 11:
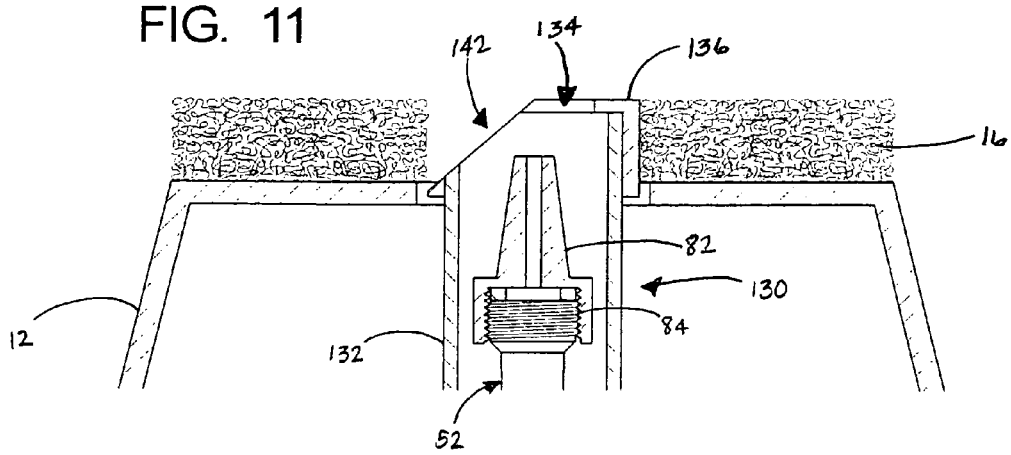
FIGS. 11-12 are partial, cross-sectional views of, respectively, the upper portion of the housing and the plunger mechanism of the soil removal apparatus in accordance with the forth embodiment, showing the manner in which the mechanism is actuated to direct the flow of water upwardly and forwardly against the bottom of a shoe or other article of footwear.

FIGS. 9-12, in turn, show a plunger member 130 in which the upper cap 132 includes a center opening 134 bordered by an upper surface 136, similar to the embodiment described with respect to FIGS. 3-5. One side of the cap and the sleeve 140, however, are cut away at a sloped angle (preferably, about 45°) to form an enlarged, angled opening 142, as shown in FIG. 10. As is shown in FIG. 11, the upper surface 136 of the plunger member lies flush with the upper surface of the flow-dispersing layer 16 when the plunger member is in its raised position. Stepping downwardly on the plunger, as indicated by arrow 144 in FIG. 12, therefore actuates the flow of water from the nozzle in the same manner as described above.

Figure 12:
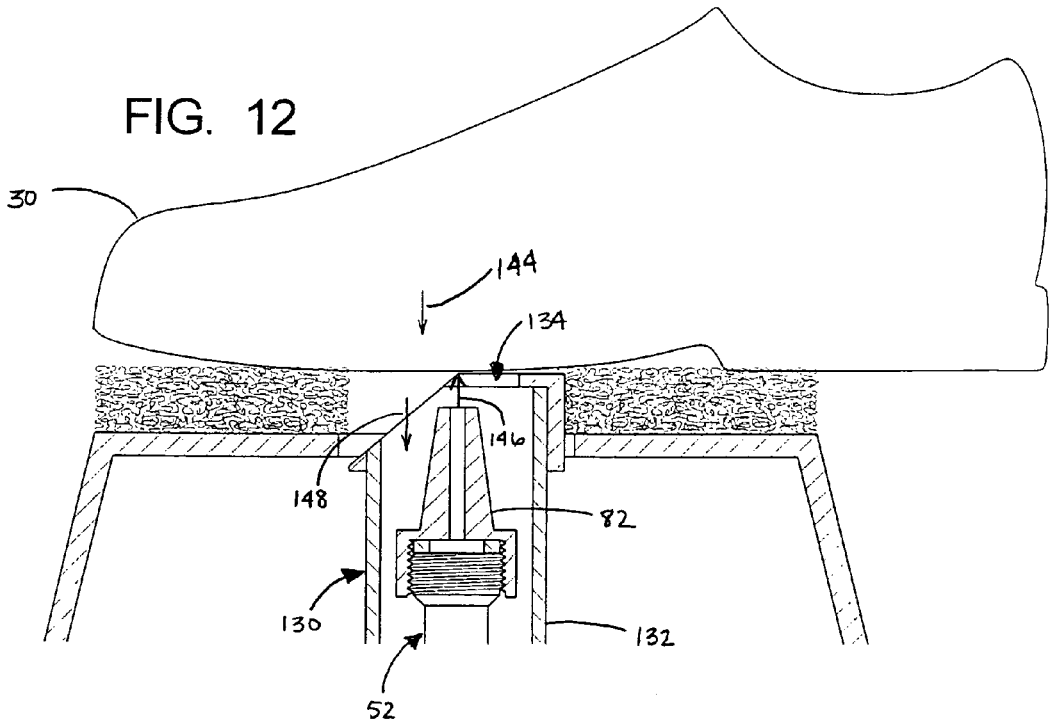

As can be seen in FIG. 12, the user's shoe 30 is preferably oriented so that the angled opening 142 is directed forwardly, i.e., toward the toe end of the shoe. The stream of water thus passes upwardly through the main opening 134 and impinges directly against the bottom of the shoe, as indicated by arrow 146. It then flows forwardly, towards the cut away side of the opening, and back down into the interior of sleeve 132 in the direction indicated by arrow 148. This provides a more defined flow path that may help dislodge and carry away heavy soil; the shoe can also be drawn against the upper edge of the opening 142, with a scraping action, to help break up and dislodge especially stubborn deposits. Moreover, directing the angled opening in a forward direction, there is less possibility for spray to escape in a direction towards the user.

The embodiments that are illustrated in FIGS. 7-12 utilize stepped and angled openings to direct the flow in a somewhat lateral direction against the shoe. It will be understood, however, that some embodiments may utilize nozzles (either the main nozzle itself or a secondary, dedicated nozzle or nozzles) that are themselves mounted or configured to direct the flow in a direction other than vertical. For example, a horizontal plunger may be included that actuates a flow from a horizontally mounted nozzle when pressed sideways.

Figure 13:
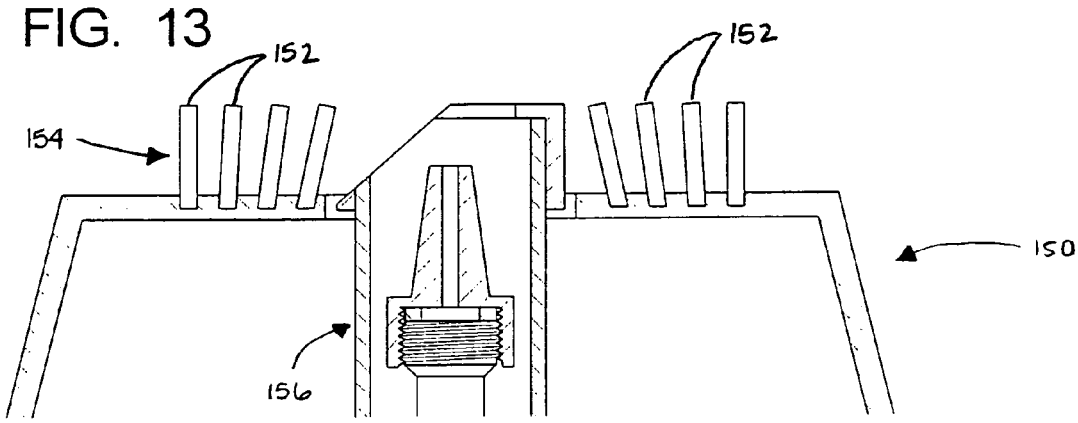
FIG. 13 is a cross-sectional view, similar to FIG. 3, of a soil removal apparatus in accordance with the fifth embodiment of the present invention, in which the flow-dissipating layer is provided by a multiplicity of resiliently flexible fingers, rather than the coarse, open-cell foam of the embodiments as shown in FIGS. 1-12.

FIG. 13 shows a soil removal apparatus 150 in accordance with the present invention that is generally similar to the embodiments described above, except that it employs a multiplicity of flexible, upwardly projecting fingers 152 to form the flow-dispersing layer 154, in place of the open-cell foam material described above. The fingers are suitably formed of a flexible rubber or plastic material, and yield resiliently by bending/deflecting under the foot, rather than compressing in the manner of the foam material, but likewise serve to break up and slow the flow to prevent the escape of spray. The fingers are preferably arranged in concentric rings about the upper end of the plunger member 156 (although other patterns and arrangements may be employed), and may work more effectively for removing soil and grass from sports cleats, as well as having certain other advantages over the foam material in terms of durability, cost and ease of cleaning; in some embodiments, soft bristles may be interspersed with or used in place of the fingers. In the illustrated embodiment, the resilient fingers suitably have a length of about ¾-1 inch.

It is to be recognized that various alterations, modifications, and/or additions may be introduced into the constructions and arrangements of parts described above without departing from the spirit or ambit of the present invention as defined by the appended claims.

What is claimed is:

1. An apparatus for removing soil from a shoe, boot or other article of footwear, said apparatus comprising:

an actuating member mounted for reciprocating movement and having a portion for being engaged by an article of footwear, wherein said actuating member comprises a plunger member having an opening in an end thereof;

a nozzle member having a discharge end directed towards said article of footwear when in engagement with said actuating member, wherein said nozzle member is positioned within said plunger member so that said discharge end of said nozzle member is directed towards said opening in said end of said plunger member;

means for actuating a flow of fluid through said nozzle member in response to said actuating member being displaced by said article of footwear in engagement therewith, so that said nozzle produces a stream of fluid that is directed against said article of footwear.

2. The apparatus of claim 1, wherein said means for actuating a flow of fluid comprises means for actuating a flow of water through said nozzle member.

3. The apparatus of claim 1, further comprising:

a flow-disbursing layer located proximate said upper end of said plunger member for receiving at least a portion of said stream of fluid that is deflected from said article of footwear, so as to prevent unwanted escape of spray from around said article of footwear while soil is being dislodged and removed therefrom.

4. The apparatus of claim 3, wherein said flow disbursing layer comprises:

a layer of porous material that surrounds said end of said plunger member.

5. The apparatus of claim 4, wherein said layer of porous material comprises:

a resiliently compressible material that compresses under pressure of said article of footwear as said plunger member is displaced thereby.

6. The apparatus of claim 5, wherein said resiliently compressible material comprises:

a resiliently compressible open-cell foam material.

7. The apparatus of claim 3, wherein said flow-disbursing layer comprises resiliently flexible fingers arranged about said end of said plunger member.

8. The apparatus of claim 7, wherein said resiliently flexible fingers are formed of a flexible rubber material.

9. The apparatus of claim 3, further comprising:

a housing having an upper surface, said end of said plunger member protruding upwardly from said upper surface of said housing when in an initial position prior to being depressed.

10. The apparatus of claim 9, wherein said flow-disbursing layer comprises:

a layer of flow-disbursing material that is mounted to said upper surface of said housing.

11. The apparatus of claim 10, wherein said end of said plunger member lies substantially flush with said upper surface of said flow-disbursing layer when said plunger member is in said initial position, so that said article of footwear makes contact with said layer of flow-disbursing material before said plunger member is depressed to a position at which said nozzle member is actuated.

12. The apparatus of claim 1, wherein said discharge opening is formed substantially centrally in said end of said plunger member.

13. The apparatus of claim 1, wherein said discharge opening is formed on a side of said end of said plunger member.

14. The apparatus of claim 1, wherein said discharge opening is angled towards a side of said upper end of said plunger member.

15. The apparatus of claim 1, wherein said nozzle member comprises:

a self-closing hose nozzle assembly, having a valve that is actuated by drawing a shaft member rearwardly, and a spring that resiliently biases the shaft member forwardly so as to move the valve to its closed position.

16. The apparatus of claim 15, wherein said means for actuating said nozzle member comprises:

a portion of said plunger member that is mounted to said shaft member of said nozzle assembly, so that said shaft member is drawn rearwardly to open said valve in response to said plunger member being displaced by said article of footwear.

17. The apparatus of claim 16, wherein said plunger member comprises:

a tubular sleeve having said nozzle assembly positioned therein.

18. The apparatus of claim 17, wherein said tubular sleeve comprises:

a lateral opening through which a handle portion of said nozzle assembly protrudes for attachment to a garden hose.

19. The apparatus of claim 1, wherein said end of said plunger member comprises:

a surface formed of a relatively smooth, low friction material so as to minimize resistance to sliding movement of said article of footwear thereon.

20. The apparatus of claim 19, wherein said surface of said end of said plunger member is formed with a contrasting color so as to provide a visual guide to a user when sliding said article of footwear on upper end of said plunger member.

21. The apparatus of claim 1, wherein said housing comprises:

a housing having substantially enclosed sides.

22. The apparatus of claim 21, wherein said housing comprises:

at least one bottom opening through which soil that is dislodged from said article of footwear and carried down said plunger member will be discharged to the ground under said housing.

* * * * *